US009293838B2

(12) United States Patent
Sakaguchi

(10) Patent No.: US 9,293,838 B2
(45) Date of Patent: Mar. 22, 2016

(54) ALUMINUM CABLE PROVIDED WITH CRIMPING TERMINAL

(71) Applicant: Yazaki Corporation, Minato-ku, Tokyo (JP)

(72) Inventor: Tadahisa Sakaguchi, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/609,521

(22) Filed: Jan. 30, 2015

(65) Prior Publication Data

US 2015/0140874 A1 May 21, 2015

Related U.S. Application Data

(63) Continuation of application No. PCT/JP2013/070513, filed on Jul. 29, 2013.

(30) Foreign Application Priority Data

Jul. 31, 2012 (JP) ..... 2012-169794

(51) Int. Cl.
*H01R 4/04* (2006.01)
*H01R 4/62* (2006.01)
*H01R 4/70* (2006.01)
(Continued)

(52) U.S. Cl.
CPC ..... *H01R 4/04* (2013.01); *H01R 4/183* (2013.01); *H01R 4/185* (2013.01); *H01R 4/20* (2013.01); *H01R 4/62* (2013.01); *H01R 4/70* (2013.01)

(58) Field of Classification Search
CPC ..... H01R 4/183; H01R 4/187; H01R 4/184; H01R 4/185
See application file for complete search history.

(56) References Cited

U.S. PATENT DOCUMENTS 3,364,460 A * 1/1968 Bergan ..... H01R 4/187 228/173.5
6,334,798 B1 * 1/2002 Ushijima ..... H01R 4/187 439/203
6,514,064 B2 * 2/2003 Kondo ..... H01R 11/12 425/116

(Continued)

FOREIGN PATENT DOCUMENTS

JP S56-067177 A 6/1981
JP H03-210776 A 9/1991

(Continued)

OTHER PUBLICATIONS

Feb. 3, 2015—PCT IPRP—App PCT/JP2013/070513—Machine English Translation.

(Continued)

*Primary Examiner* — Ross Gushi
(74) *Attorney, Agent, or Firm* — Banner & Witcoff, Ltd.

(57) ABSTRACT

A crimping portion includes a first crimping portion including a conductor crimping portion and a conductor enveloping portion that is integrally connected to the conductor crimping portion and envelops a portion of a conductor in the vicinity of an insulating covering portion, and a second crimping portion that is separate from the first crimping portion and crimped to the insulating covering portion in the vicinity of the conductor. A gap between the first crimping portion and the second crimping portion is sealed with a sealer, and thus the first crimping portion and the second crimping portion are integrally interconnected to each other.

5 Claims, 8 Drawing Sheets

(51) Int. Cl.
*H01R 4/18* (2006.01)
*H01R 4/20* (2006.01)

(56) References Cited

U.S. PATENT DOCUMENTS 6,613,263 B2 * 9/2003 Kondo ..... H01R 11/12 264/263
6,666,732 B1 * 12/2003 Endacott ..... H01R 4/187 439/730
6,761,551 B2 * 7/2004 Kondo ..... B29C 45/14426 425/116
6,796,781 B2 * 9/2004 Kondo ..... B29C 45/14426 249/95
7,048,551 B2 * 5/2006 Takayama ..... H01R 4/185 439/67
7,115,004 B2 * 10/2006 Takayama ..... H01R 4/185 439/850
7,207,850 B2 * 4/2007 Takayama ..... H01R 4/185 439/850
7,364,478 B2 * 4/2008 Xu ..... H01R 4/187 439/730
7,374,466 B2 * 5/2008 Onuma ..... H01R 11/28 439/874
7,494,388 B2 * 2/2009 Kakuta ..... H01R 4/185 439/877
7,828,610 B2 * 11/2010 Lehmann ..... H01R 4/187 29/860
7,905,755 B1 * 3/2011 Martauz ..... H01R 4/184 205/118
8,607,449 B2 * 12/2013 Kitagawa ..... H01R 4/185 174/110 R
8,723,040 B2 * 5/2014 Sakura ..... H01R 4/185 174/68.1
8,771,015 B2 * 7/2014 Inoue ..... H01R 4/70 437/604
8,802,987 B2 * 8/2014 Morikawa ..... H01R 4/20 174/68.1
8,834,213 B2 * 9/2014 Sato ..... H01R 4/185 439/866
8,876,564 B2 * 11/2014 Sato ..... H01R 4/184 439/879
8,900,010 B2 * 12/2014 Aoki ..... H01R 4/185 439/587
8,927,863 B2 * 1/2015 Tanikawa ..... H02G 15/04 174/74 A
8,974,258 B2 * 3/2015 Mitose ..... H01R 4/184 439/877
9,011,188 B2 * 4/2015 Aoki ..... H01R 4/023 439/874
9,022,821 B2 * 5/2015 Matsushita ..... H01R 4/185 439/879
9,033,751 B2 * 5/2015 Sato ..... H01R 4/188 439/877
9,065,196 B2 * 6/2015 Ohnuma ..... H01R 4/184
9,065,261 B2 * 6/2015 Kawamura ..... H01R 4/183
9,070,988 B2 * 6/2015 Sato ..... H01R 4/184
9,083,100 B2 * 7/2015 Uno ..... H01R 4/70
9,172,151 B2 * 10/2015 Sato ..... H01R 4/206
2001/0003688 A1 * 6/2001 Kondo ..... B29C 45/14426 439/604
2002/0028612 A1 * 3/2002 Ushijima ..... H01R 4/187 439/879
2005/0003709 A1 * 1/2005 Nagamine ..... H01R 43/005 439/587
2005/0227549 A1 * 10/2005 Takayama ..... H01R 4/185 439/851
2005/0227550 A1 * 10/2005 Takayama ..... H01R 4/185 439/851
2010/0084159 A1 * 4/2010 Drew ..... H01R 4/183 174/113 R
2012/0325552 A1 * 12/2012 Sakura ..... H01R 4/185 174/74 R
2012/0329318 A1 * 12/2012 Aoki ..... H01R 4/023 439/521
2013/0045644 A1 * 2/2013 Aoki ..... H01R 4/183 439/878
2013/0052887 A1 * 2/2013 Inoue ..... H01R 4/62 439/877
2013/0072074 A1 * 3/2013 Inoue ..... H01R 4/70 439/886
2013/0126235 A1 * 5/2013 Tanikawa ..... H02G 15/04 174/77 R
2013/0130569 A1 * 5/2013 Sato ..... H01R 4/206 439/882
2013/0199842 A1 * 8/2013 Inoue ..... H01R 4/62 174/84 C
2013/0213709 A1 * 8/2013 Kawamura ..... H01R 4/183 174/72 A
2013/0309903 A1 * 11/2013 Iio ..... H01R 13/5216 439/523
2014/0106628 A1 * 4/2014 Sato ..... H01R 4/188 439/877
2014/0144016 A1 * 5/2014 Bauer ..... B23K 26/20 29/863
2014/0151083 A1 * 6/2014 Ohnuma ..... H01R 4/184 174/93
2014/0224536 A1 * 8/2014 Ito ..... H01R 4/184 174/84 C
2014/0273667 A1 * 9/2014 Tachibana ..... H01R 43/048 439/877
2014/0374155 A1 * 12/2014 Tachibana ..... H01R 4/62 174/84 C
2014/0378009 A1 * 12/2014 Yamada ..... H01R 4/187 439/865
2015/0011116 A1 * 1/2015 Ohnuma ..... H01R 4/185 439/519
2015/0011117 A1 * 1/2015 Ohnuma ..... H01R 4/185 439/520
2015/0017833 A1 * 1/2015 Sato ..... H01R 4/184 439/519
2015/0021090 A1 * 1/2015 Mano ..... H01R 4/185 174/72 A
2015/0140202 A1 * 5/2015 Sato ..... H01R 4/185 427/58
2015/0140856 A1 * 5/2015 Sato ..... H01R 4/70 439/523
2015/0140874 A1 * 5/2015 Sakaguchi ..... H01R 4/62 439/879
2015/0244133 A1 * 8/2015 Hanazaki ..... H01R 4/184 174/74 R
2015/0287496 A1 * 10/2015 Sato ..... H01R 4/62 174/74 R
2015/0318654 A1 * 11/2015 Kawamura ..... H01R 43/048 439/877

FOREIGN PATENT DOCUMENTS

JP 2011-243329 A 12/2011
JP 2012-099219 A 5/2012

OTHER PUBLICATIONS

Oct. 1, 2013—International Search Report—Intl App PCT/JP2013/070513—English Translation.

* cited by examiner

ALUMINUM CABLE PROVIDED WITH CRIMPING TERMINAL

CROSS REFERENCE TO RELATED APPLICATIONS

This application is a continuation of international patent application No. PCT/JP2013/070513 filed on Jul. 29, 2013 based on Japanese Patent Application No. 2012-169794 filed on Jul. 31, 2012, the contents of which are incorporated herein by reference.

BACKGROUND OF THE INVENTION

1. Field of the Invention

The present invention relates to an aluminum cable provided with crimping terminal.

2. Description of the Related Art

In the related art, as a cable with a terminal which is used in a wire harness or the like that is arranged in a vehicle, a cable provided with crimping terminal, in which the crimping terminal is crimped to a conductor, is used.

Recently, in the vehicle industry, an improvement in fuel efficiency through weight reduction of a vehicle has been an important problem in consideration of the environment. Accordingly, an aluminum cable with crimping terminal, in which a conductor formed of aluminum or an aluminum alloy which is lighter than copper is used, has attracted attention.

However, aluminum tends to be corroded under the presence of water and copper ions, and thus when water intrudes into a connection portion between the conductor formed of aluminum or an aluminum alloy and the crimping terminal formed of copper, there is a problem that corrosion tends to occur.

Accordingly, to prevent corrosion of the conductor by blocking adhesion of water to the conductor, JP-A-2011-243329 discloses an aluminum cable with crimping terminal by which intrusion of water to the conductor is prevented by using a crimping terminal in which a portion crimped to the conductor and a portion crimped to an insulating covering portion are integrally formed.

SUMMARY OF THE INVENTION

However, in the aluminum cable with crimping terminal which is disclosed in JP-A-2011-243329, since the portion that is crimped to the conductor and the portion that is crimped to the insulating covering portion are integrally formed, the portion to be crimped to the conductor and the portion to be crimped to the insulating covering portion are crimped and deformed while being affected by each other. Therefore, it is difficult to crimp the crimping terminal to the insulating covering portion without a gap, and thus there is a concern that water may intrude from a gap formed between the portion crimped to the insulating covering portion and the insulating covering portion.

The present invention has been made in consideration of the above-described circumstances, and an object thereof is to provide an aluminum cable with crimping terminal in which a portion to be crimped to a conductor and a portion to be crimped to an insulating covering portion are integrally formed, capable of improving a waterproof property of the portion crimped to the insulating covering portion.

The above object according to the present invention is achieved by the following configurations.

(1) An aluminum cable with crimping terminal including: an aluminum cable including a conductor formed of aluminum or aluminum alloy and an insulating covering portion that envelops an outer periphery of the conductor, and a crimping terminal including a crimping portion that is crimped to the aluminum cable and electrically connected to the aluminum cable, wherein the crimping portion includes a first crimping portion including a conductor crimping portion that is crimped to the conductor exposed by removing the insulating covering portion on the terminal portion of the aluminum cable, and a conductor enveloping portion that is integrally connected to the conductor crimping portion along an extending direction of the aluminum cable, and deformed when being crimped to the aluminum cable in substantially the same shape as a case of being crimped to the insulating covering portion so as to envelop a portion of the conductor in a vicinity of the insulating covering portion, and a second crimping portion that is formed of a tubular metallic member separate from the first crimping portion, and crimped to an outer peripheral surface of the insulating covering portion in a vicinity of the conductor of the aluminum cable that is inserted into the tube, and wherein the first crimping portion and the second crimping portion are integrally interconnected to each other by sealing a gap of the first crimping portion that is crimped to the aluminum cable with a sealer, and by sealing a gap between the first crimping portion and the second crimping portion with the sealer.

(2) The aluminum cable with crimping terminal according to the configuration (1), wherein the second crimping portion has the same thickness as the first crimping portion.

(3) The aluminum cable with crimping terminal according to the configuration (1) or (2), wherein the sealer is a conductive material.

(4) The aluminum cable with crimping terminal according to the configuration (1) or (2), wherein the sealer is a conductive material, and the conductor enveloping portion is integrally connected to the conductor crimping portion along an extending direction of the aluminum cable without a gap between the conductor enveloping portion and the conductor crimping portion.

(5) The aluminum cable with crimping terminal according to the configuration (1) or (2), wherein the sealer is a conductive material, and the conductor enveloping portion is integrally connected to the conductor crimping portion along an extending direction of the aluminum cable without a gap between the conductor enveloping portion and the conductor crimping portion.

In the aluminum cable with crimping terminal according to the configuration (1), the first crimping portion and the second crimping portion are configured as separate bodies. Accordingly, the second crimping portion is crimped to the insulating covering portion in a close contact manner without being affected by deformation of the first crimping portion. The first crimping portion and the second crimping portion, which are crimped, are integrally interconnected to each other by the sealer, and thus it is possible to improve a waterproof property of the portion crimped to the insulating covering portion while integrally forming the portion crimped to the conductor and the portion crimped to the insulating covering portion.

In the aluminum cable with crimping terminal according to the configuration (2), an edge face of the first crimping portion and an edge face of the second crimping portion, which face each other, have approximately the same shape, and thus it is easy to clog a gap between the first crimping portion and the second crimping portion with the sealer.

In the aluminum cable with crimping terminal according to the configuration (3), all of the sealer and the crimping terminal are constituted by a conductive material as a whole, and thus it is possible to increase integrity as a crimping terminal.

In the aluminum cable with crimping terminal according to the configuration (4) and (5), the conductor enveloping portion is integrally connected to the conductor crimping portion along an extending direction of the aluminum cable without a gap between the conductor enveloping portion and the conductor crimping portion, and thus it is possible to further increase a waterproof performance due to the crimping terminal.

DETAILED DESCRIPTION OF THE EXEMPLARY EMBODIMENTS

Hereinafter, a preferred embodiment of an aluminum cable with crimping terminal according to the present invention will be described in detail with reference to the accompanying drawings.

EXAMPLE

Figure 1:
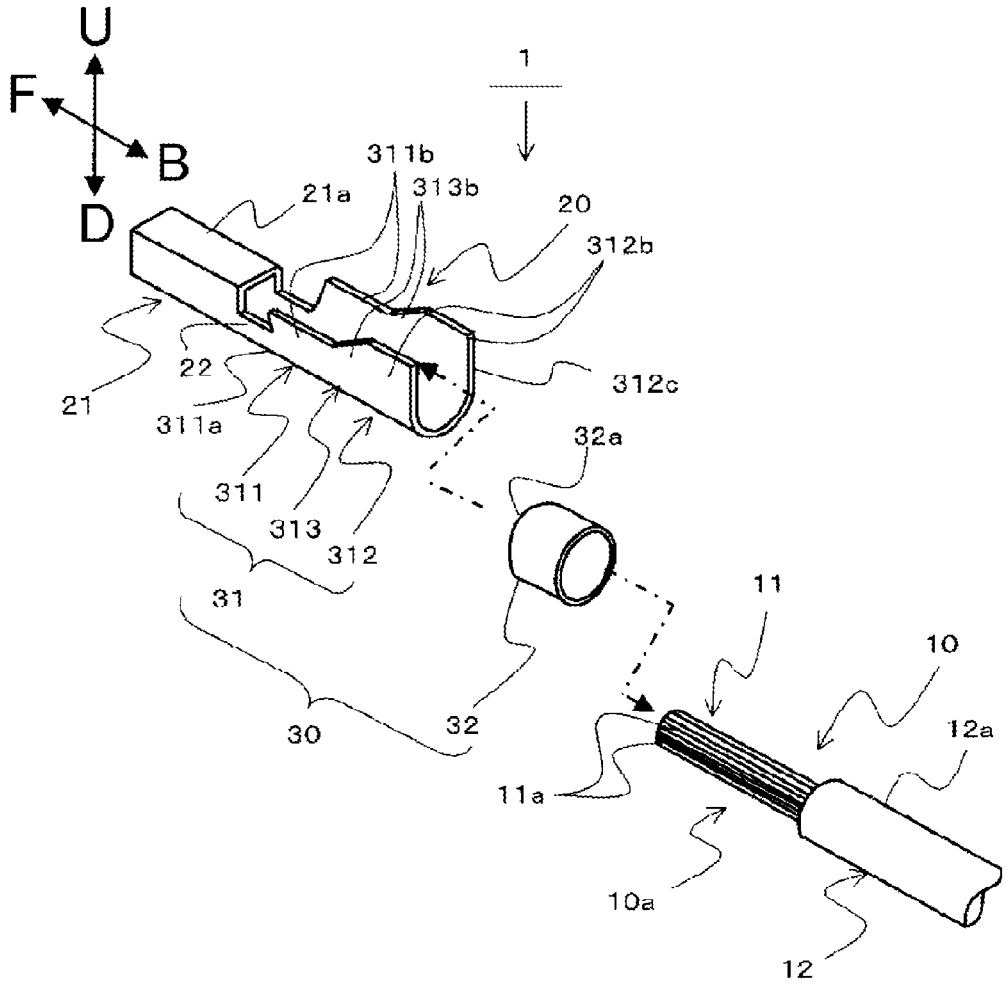
FIG. 1 is an exploded perspective view of an aluminum cable with crimping terminal according to an embodiment of the present invention.
Figure 2:
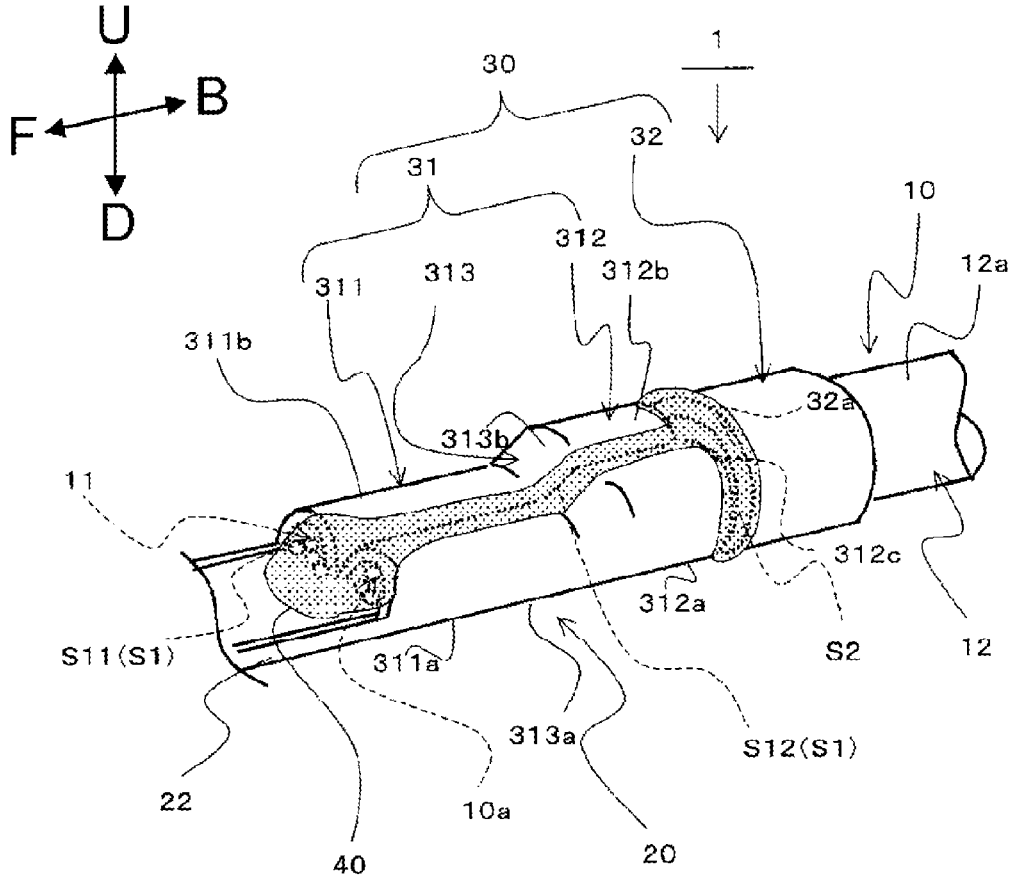
FIG. 2 is an enlarged view of the periphery of a crimping portion of a crimping terminal in the aluminum cable with crimping terminal shown in FIG. 1.
Figure 3:
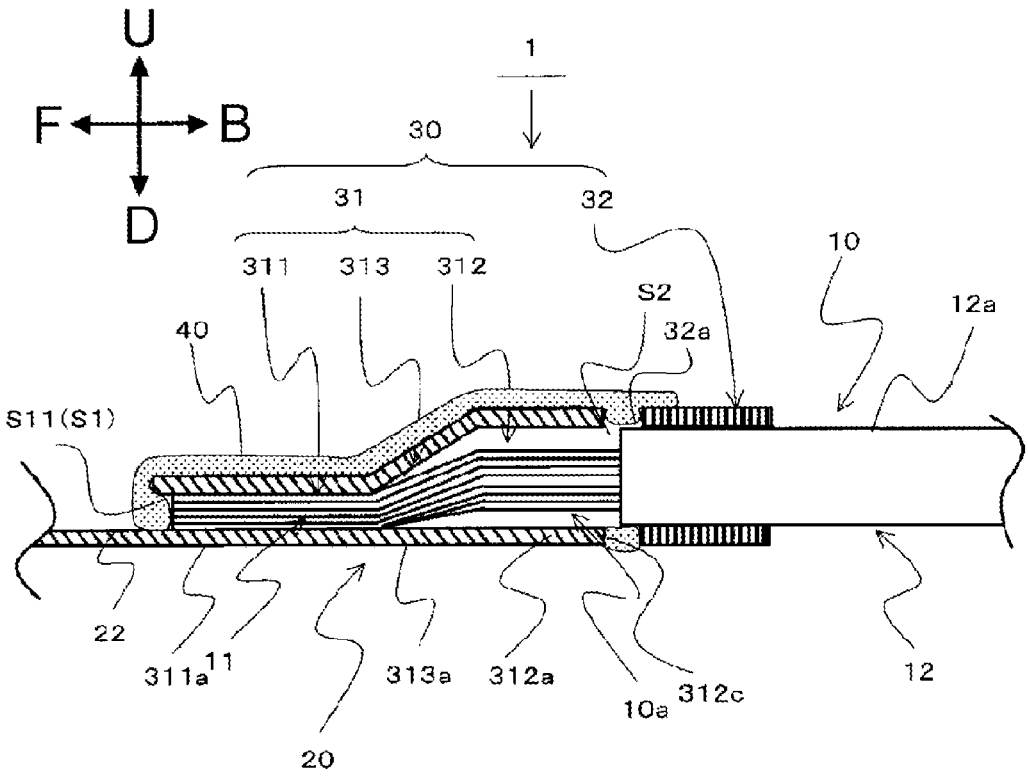
FIG. 3 is a cross-sectional view of the aluminum cable with crimping terminal shown in FIG. 2 when viewed from a lateral side.
Figure 4:
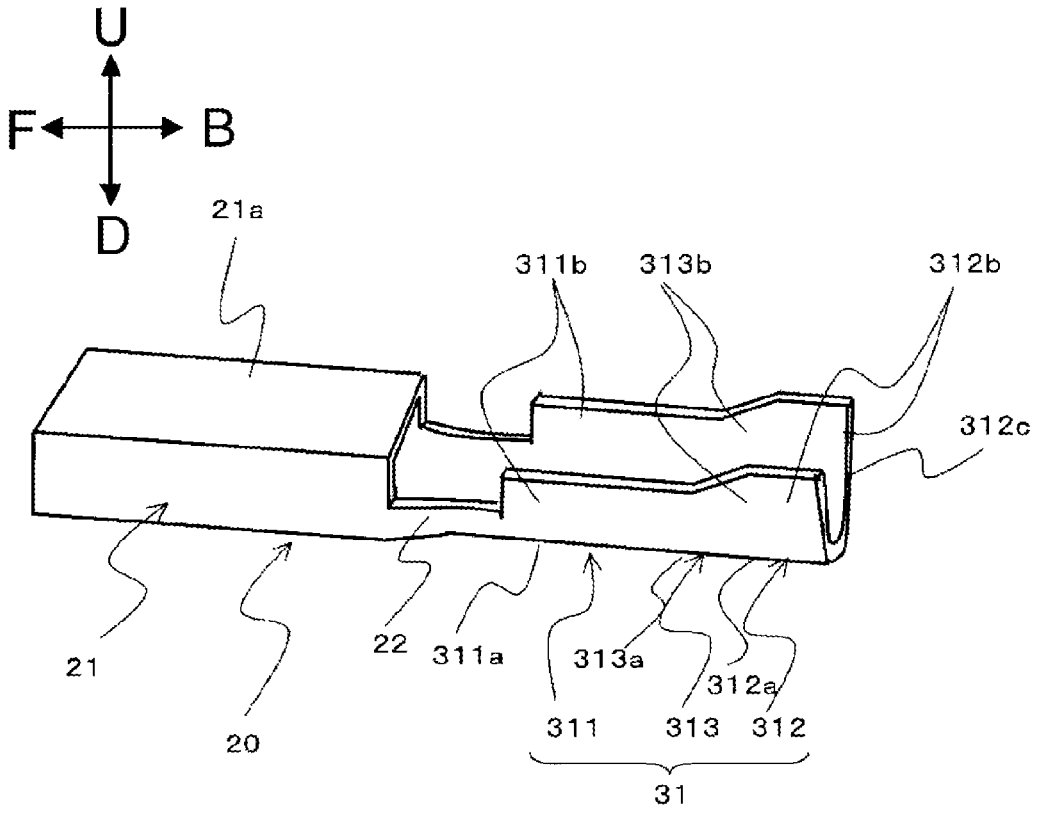
FIG. 4 is an enlarged perspective view of the crimping terminal shown in FIG. 1.

FIG. 1 is an exploded perspective view of an aluminum cable 1 with crimping terminal according to an embodiment of the present invention.

In addition, FIG. 1 omits a sealer 40 that is applied to a gap of a crimping terminal 20 that is crimped to an aluminum cable 10.

In addition, in this embodiment of the present invention, for ease of explanation, a forward direction (F), a backward direction (B), an upper direction (U), and a downward direction (D) are defined as indicated by arrows in the drawings.

The aluminum cable 1 with crimping terminal according to the embodiment of the present invention includes an aluminum cable 10 including a conductor 11 that is formed of aluminum or an aluminum alloy and an insulating covering portion 12 that envelops an outer periphery of the conductor 11, and a crimping terminal 20 including a crimping portion 30 that is crimped to the aluminum cable 10 and electrically connected to the aluminum cable 10.

First, the aluminum cable 10 will be described.

The conductor 11 is formed by twisting a plurality of strands 11*a* formed of aluminum or aluminum alloy.

The insulating covering portion 12 is formed of an insulating synthetic resin and envelops an outer periphery of the conductor 11 to protect the conductor 11 from the outside in an insulating manner.

In addition, with regard to the conductor 11, a configuration in which the plurality of strands 11*a* are twisted is exemplified. However, there is no limitation to this configuration, and the conductor 11 may be a single core wire formed of aluminum or an aluminum alloy.

Next, the crimping terminal 20 will be described.

The crimping terminal 20 includes a counterpart terminal connection portion 21 which is a connection portion with a connection counterpart terminal (not shown), a crimping portion 30, and an intermediate portion 22 as a portion which is formed between the counterpart terminal connection portion 21 and the crimping portion 30 and at which the counterpart terminal connection portion 21 and the crimping portion 30 are interconnected to each other.

The counterpart terminal connection portion 21 is configured in such a manner that a counterpart terminal (not shown) comes into contact with an elastic contact piece (not shown) provided inside a tube that is a connection body 21*a* having a square tube shape.

The crimping portion 30 includes a first crimping portion 31 including a portion that is crimped to an exposed part of the conductor 11, and a second crimping portion 32 that is formed by a tubular metallic member as a body separate from the first crimping portion 31 and is crimped to an outer peripheral surface 12*a* of the insulating covering portion 12. In the crimping portion 30, a gap S1 between the aluminum cable 10 and the first crimping portion 31 that is crimped to the aluminum cable 10 is sealed with a sealer 40, and a gap S2 between the first crimping portion 31 and the second crimping portion 32 is sealed with the sealer 40 to integrally interconnect the first crimping portion 31 and the second crimping portion 32.

In addition, in this embodiment, as the sealer 40, for example, a conductive material such as solder is used.

The first crimping portion 31 is molded by pressing a flat plate formed of a metal such as copper or a copper alloy by molding pressing and the like. The first crimping portion 31 includes a conductor crimping portion 311 that is crimped to the conductor 11 exposed by removing the insulating covering portion 12 on a terminal portion 10*a* of the aluminum cable 10, a conductor enveloping portion 312 that is integrally connected to the conductor crimping portion 311 along an extending direction of the aluminum cable 10 without a gap with the conductor crimping portion 311, envelops a portion of the conductor 11 in the vicinity of the insulating covering portion 12, and is deformed in approximately the same shape as that in a case of being crimped to the insulating covering portion 12 when being crimped to the aluminum cable 10, and an integral interconnection portion 313 that integrally interconnects the conductor crimping portion 311 and the conductor enveloping portion 312.

The conductor crimping portion 311 includes a conductor crimping bottom wall portion 311*a* on which the exposed conductor 11 is mounted, and a pair of conductor crimping erected-wall portions 311*b* that are erected from both edges of the conductor crimping bottom wall portion 311*a* and are crimped to envelop the outer periphery of the conductor 11 in a range from both side portions of the conductor 11 to an upper portion thereof.

The width of the respective conductor crimping erected-wall portions 311*b* in a height direction is set to a dimension with which a pair of upper edges of the pair of conductor crimping erected-wall portions 311*b* become a joint and thus the outer periphery of the conductor 11 is enveloped. That is, the width of the respective conductor crimping erected-wall portion 311*b* in a height direction is set in accordance with a diameter of the conductor 11.

The conductor enveloping portion 312 is a portion that is integrally connected to the conductor crimping portion 311 along the extending direction of the aluminum cable 10 without a gap with the conductor crimping portion 311, and forms an end of the first crimping portion 31 on a side connected to the aluminum cable 10.

The conductor enveloping portion 312 includes a conductor enveloping bottom wall portion 312*a* on which the exposed conductor 11 is mounted, and a pair of conductor enveloping erected-wall portions 312*b* that are erected from both edges of the conductor enveloping bottom wall portion 312*a* and envelop the outer periphery of the conductor 11 in a range from both side portions to an upper portion. The width of the respective conductor enveloping erected-wall portions 312*b* in a height direction is set to a dimension with which a pair of upper end edges of the pair of conductor enveloping erected-wall portions 312*b* become a joint and thus the outer periphery of the exposed conductor 11 is enveloped.

More specifically, when being crimped to the aluminum cable 10, the conductor enveloping portion 312 is deformed in a tubular shape along a joint S12 extending along the extending direction of the aluminum cable 10 and is deformed in order for an edge face 312*c* to face an edge face 32*a* of the second crimping portion 32 crimped to the insulating covering portion 12.

That is, in a case where the crimping terminal 20 is crimped to the aluminum cable 10, the conductor enveloping portion 312 is deformed in a shape with which the gap S2 between the first crimping portion 31 and the second crimping portion 32 can be easily clogged with the sealer 40.

A front end of the integral interconnection portion 313 is integrally connected to the conductor crimping portion 311 and a rear end of the integral interconnection portion 313 is integrally connected to the conductor enveloping portion 312. The integral interconnection portion 313 includes an interconnection bottom wall portion 313*a* that forms a bottom wall of the integral interconnection portion 313, and a pair of interconnection side wall portions 313*b* in which front ends are integrally connected to the pair of conductor crimping erected-wall portions 311*b*, respectively, and rear ends are integrally connected to the pair of conductor enveloping erected-wall portions 312*b*, respectively.

The front ends and the rear ends of the interconnection side wall portions 313*b* are connected to the conductor crimping erected-wall portions 311*b* and the conductor enveloping erected-wall portions 312*b*, which have widths different from each other in a height direction, respectively. Accordingly, upper edge faces of the interconnection side wall portions 313*b* are formed in a rising inclined surface shape from the front ends toward the rear ends.

The second crimping portion 32 is formed of the same kind of metal as the first crimping portion 31, and is a portion that is crimped to the outer peripheral surface 12*a* of the insulating covering portion 12 in the vicinity of the exposed conductor 11 of the aluminum cable 10 inserted into the tube. The second crimping portion 32 is configured to be integrally interconnected to the first crimping portion 31 when the gap S2 with the first crimping portion 31 is sealed with the sealer 40 that seals the gap S1 of the first crimping portion 31 crimped to the aluminum cable 10.

In addition, the second crimping portion 32 has the same thickness as the first crimping portion 31. Accordingly, the second crimping portion 32 is configured to be crimped to the insulating covering portion 12 while being deformed in substantially the same shape as the conductor enveloping portion 312 as a portion that envelops the exposed conductor 11 and is deformed in substantially the same shape as in a case of being crimped to the insulating covering portion 12.

In a case where the crimping terminal 20 is crimped to the aluminum cable 10, the joint S12 and an opening S11 which exist in the gap S1 of the first crimping portion 31, and the gap S2 between the first crimping portion 31 and the second crimping portion 32 are sealed with the sealer 40. According to this, the crimping terminal 20 functions as a crimping terminal in which the first crimping portion 31 and the second crimping portion 32 are integrally interconnected to each other.

Here, description will be given to a sequence of attaching the crimping terminal 20 to the aluminum cable 10 of the aluminum cable 1 with crimping terminal according to the embodiment of the present invention with reference to FIGS. 5A to 5D. FIGS. 5A to 5D are diagrams illustrating the sequence of attaching the crimping terminal 20 to the aluminum cable 10 of the aluminum cable 1 with crimping terminal according to an example of the present invention.

Figure 5A:
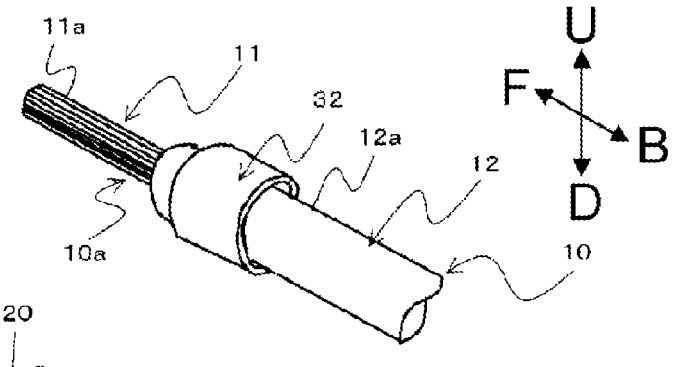
FIGS. 5A, 5B, 5C and 5D are diagrams illustrating a sequence of attaching a crimping terminal to the aluminum cable of the aluminum cable with crimping terminal according to the embodiment of the present invention.

First, as shown in FIG. 5A, after inserting the aluminum cable 10 into the second crimping portion 32, a worker removes the insulating covering portion 12 of the terminal portion 10*a* of the aluminum cable 10.

Figure 5B:
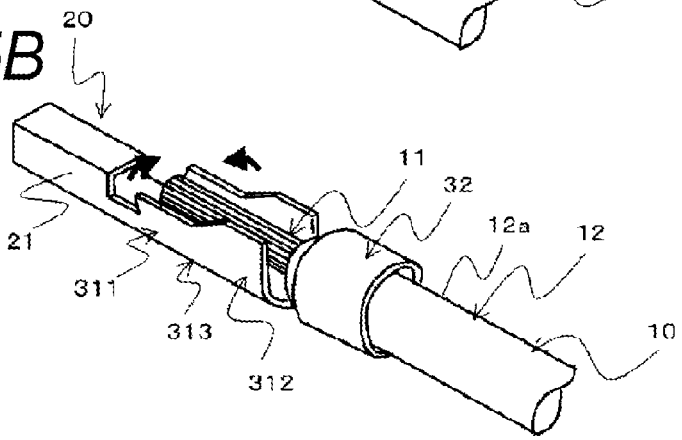
Figure 5C:
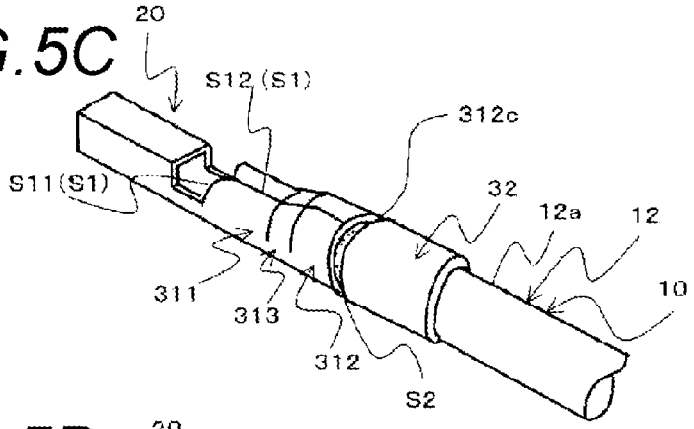

Then, as shown in FIGS. 5B and 5C, the operator crimps the crimping terminal 20 to the aluminum cable 10. In this process, the first crimping portion 31 and the second crimping portion 32 are positioned at a predetermined position, and then the first crimping portion 31 and the second crimping portion 32 are crimped to the aluminum cable 10 by using a mold (not shown) and the like.

That is, the conductor crimping portion 311 of the first crimping portion 31 is crimped to the front end of the exposed conductor 11, the conductor enveloping portion 312 of the first crimping portion 31 is deformed to envelop a portion of the conductor 11 in the vicinity of the insulating covering portion 12, and the second crimping portion is crimped to the outer peripheral surface 12*a* of the insulating covering portion 12 in the vicinity of the conductor 11.

According to this, the conductor enveloping portion 312 of the first crimping portion 31 and the second crimping portion 32 are deformed in such a manner that edge faces 312*c* and 32*a* thereof face each other.

In addition, in this process, the first crimping portion 31 and the second crimping portion 32 are crimped to the aluminum cable 10 as separate bodies, and thus the first crimping portion 31 and the second crimping portion 32 are deformed without being affected by each other and are crimped to the aluminum cable 10.

Figure 5D:
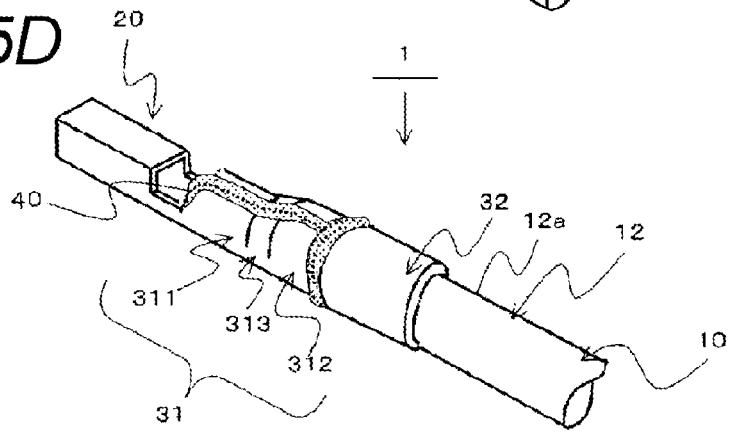

Finally, as shown in FIG. 5D, a worker seals the gaps S1 and S2 of the crimping terminal 20, which is crimped to the aluminum cable 10, with the sealer 40 to complete a process of attaching the crimping terminal 20 to the aluminum cable 10. In this process, the joint S12 and the opening S11, which exist in the gap S1 of the first crimping portion 31, are sealed with the sealer 40, and the gap S2 between the first crimping portion 31 and the second crimping portion 32 is clogged with the sealer 40, and thus the first crimping portion 31 and the second crimping portion 32 are integrally interconnected to each other.

In addition, in this process, it is not necessary to add a process of interconnecting the first crimping portion 31 and the second crimping portion 32 or a material for the connection so as to connect the first crimping portion 31 and the second crimping portion 32 by using the sealer 40 that seals the gap S1 of the first crimping portion 31.

In the aluminum cable 1 with crimping terminal according to the embodiment of the present invention, the first crimping portion 31 and the second crimping portion 32 are configured as separate bodies. Accordingly, the second crimping portion 32 is crimped to the insulating covering portion 12 in a close contact manner without being affected by deformation of the first crimping portion 31. The first crimping portion 31 and the second crimping portion 32, which are crimped, are integrally connected to each other by the sealer 40. Accordingly, it is possible to improve the waterproof property of the portion to be crimped to the insulating covering portion 12 while integrally forming the portion crimped to the conductor 11 and the portion crimped to the insulating covering portion 12.

In addition, in the aluminum cable 1 with crimping terminal according to the embodiment of the present invention, the edge face 312*c* of the first crimping portion 31 and the edge face 32*a* of the second crimping portion 32, which face each other, have substantially the same shape. Accordingly, it is possible to easily clog the gap S2 between the first crimping portion 31 and the second crimping portion 32 with the sealer 40.

In addition, in the aluminum cable 1 with crimping terminal according to the embodiment of the present invention, all of the sealer 40 and the crimping terminal 20 are constituted by a conductive material as a whole, and thus it is possible to increase integrity as the crimping terminal 20.

In addition, in the aluminum cable 1 with crimping terminal according to the embodiment of the present invention, the conductor enveloping portion 312 is integrally connected to the conductor crimping portion 311 along an extending direction of the aluminum cable 10 without a gap between the conductor enveloping portion 312 and the conductor crimping portion 311. Accordingly, it is possible to further increase a waterproof performance due to the crimping terminal 20.

Modification Example 1

Figure 6:
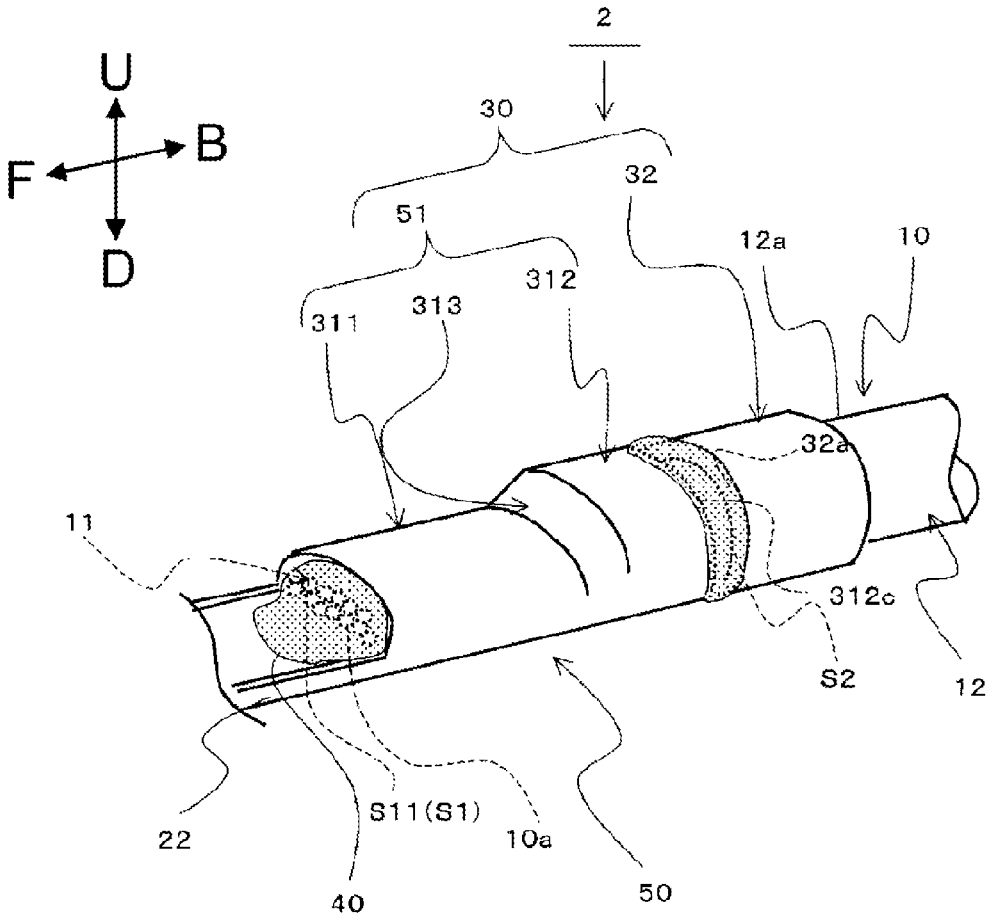
FIG. 6 is a perspective view of main portions of an aluminum cable with crimping terminal according to Modification Example 1 of the embodiment of the present invention.

Next, Modification Example 1 of the aluminum cable 1 with crimping terminal according to the embodiment of the present invention will be described with reference to FIG. 6. FIG. 6 is a perspective view of main portions of an aluminum cable 2 with crimping terminal according to Modification Example 1 of the embodiment of the present invention.

The aluminum cable 2 with crimping terminal of Modification Example 1 is different from the aluminum cable 1 with crimping terminal of the example in that a crimping terminal 50 is provided instead of the crimping terminal 20.

The other configurations are the same as the example, and the same reference numerals are given to the same constituent portions as the example.

The crimping terminal 50 is a so-called closed barrel type crimping terminal. Accordingly, the crimping terminal 50 is configured in such a manner that the sealer 40 is applied to the opening S11 and the gap S2 between a first crimping portion 51 and the second crimping portion 32.

The aluminum cable 2 with crimping terminal of Modification Example 1 has the same effect as the aluminum cable 1 with crimping terminal according to the example, and it is possible to suppress a portion of the conductor 11, which is exposed from the crimping terminal 50, to be small. Accordingly, it is possible to further increase the waterproof performance due to the crimping terminal 50.

Modification Example 2

Figure 7:
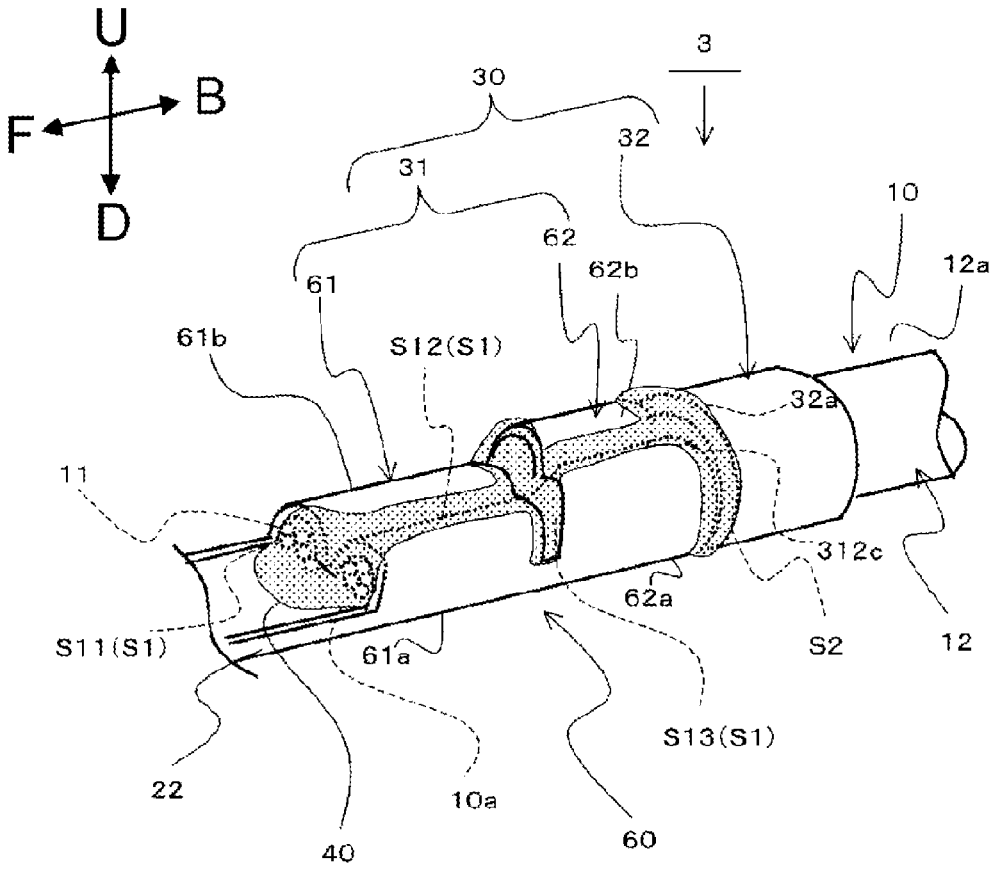
FIG. 7 is a perspective view illustrating main portions of an aluminum cable with crimping terminal according to Modification Example 2 of the embodiment of the present invention.
Figure 8:
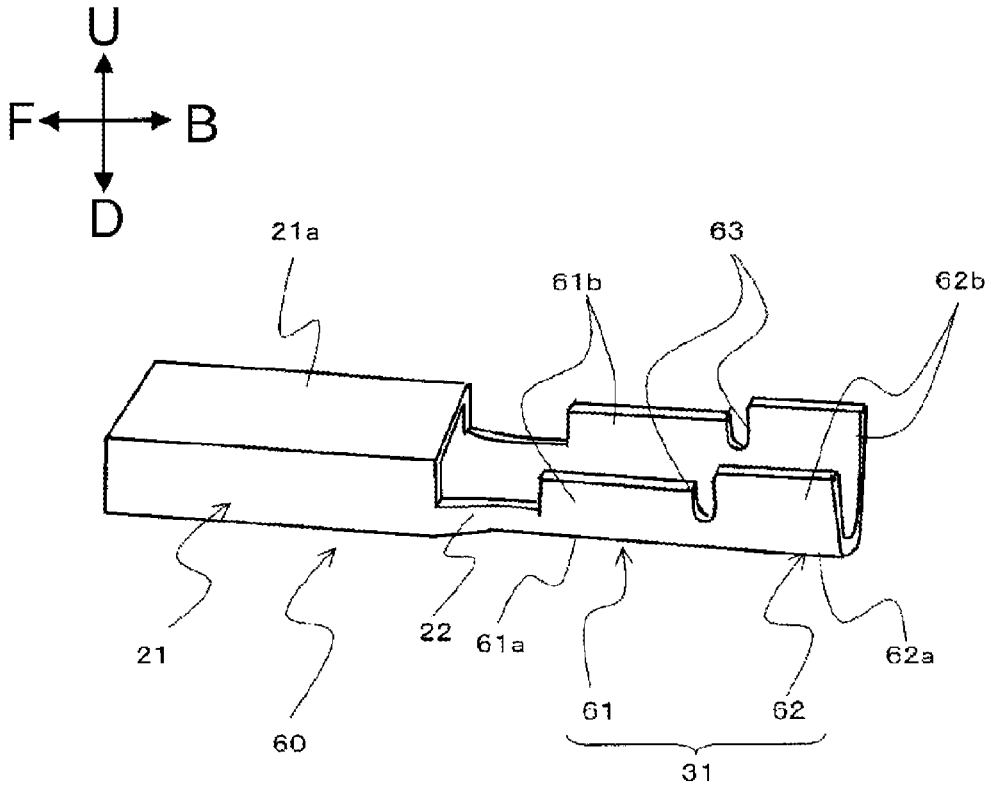
FIG. 8 is an enlarged perspective view of the crimping terminal shown in FIG. 7.

Next, Modification Example 2 of the aluminum cable 1 with crimping terminal according to the embodiment of the present invention will be described with reference to FIGS. 7 and 8. FIG. 7 is a perspective view of main portions of an aluminum cable 3 with crimping terminal according to Modification Example 2 of the embodiment of the present invention. FIG. 8 is an enlarged perspective view of a crimping terminal 60 shown in FIG. 7.

The aluminum cable 3 with crimping terminal of Modification Example 2 is different from the aluminum cable 1 with crimping terminal of the example in that the crimping terminal 60 is provided instead of the crimping terminal 20.

The other configurations are the same as the example, and the same reference numerals are given to the same constituent portions as the example.

As shown in FIG. 8, a conductor crimping portion 61 of the crimping terminal 60 includes a conductor crimping bottom wall portion 61*a* on which the conductor 11 is mounted, and a pair of conductor crimping erected-wall portions 61*b* which are erected from both edges of the conductor crimping bottom wall portion 61*a* and are crimped to envelop the outer periphery of the conductor 11 in a range from both side portions of the conductor 11 to an upper portion thereof.

In addition, a conductor enveloping portion 62 of the crimping terminal 60 includes a conductor enveloping bottom wall portion 62*a* on which the exposed conductor 11 is mounted, and a pair of conductor enveloping erected-wall portions 62*b* which are erected from both edges of the conductor enveloping bottom wall portion 62*a* and envelop the outer periphery of the conductor 11 in a range from both side portions of the conductor 11 to an upper portion thereof.

As shown in FIG. 8, in the crimping terminal 60, a pair of cut-out portions 63 which are downwardly cut out from an upper edge face, are formed between the conductor crimping portion 61 and the conductor enveloping portion 62, and thus the width of the pair of conductor crimping erected-wall portions 61*b* in a height direction and the width of the pair of conductor enveloping erected-wall portions 62*b* in a height direction are configured to be largely variable. That is, the crimping terminal 60 has a configuration not having the integral interconnection portion 313 in the aluminum cable 1 with crimping terminal in the example.

In a case of using the crimping terminal 60, an opening S13 as the gap S1 that is formed by the pair of cut-out portions 63 is configured to be sealed with the sealer 40.

The aluminum cable 3 with crimping terminal of Modification Example 2 has the same effect as the aluminum cable 1 with crimping terminal according to the example.

In addition, in the aluminum cables 1 and 2 with crimping terminal according to the embodiment of the present invention, a configuration of using solder as the sealer 40 is exemplified. However, there is no limitation thereto, and a synthetic resin such as an ultraviolet curable resin may be used.

Here, characteristics of the embodiment of the aluminum cable with crimping terminal according to the present invention will be described below in a brief and collective manner.

[1] An aluminum cable 1 with crimping terminal including: an aluminum cable 10 including a conductor 11 formed of aluminum or aluminum alloy and an insulating covering portion 12 that envelops an outer periphery of the conductor 11, and a crimping terminal 20 including a crimping portion 30 that is crimped to the aluminum cable 10 and electrically connected to the aluminum cable 10, wherein the crimping portion 30 includes a first crimping portion 31 including a conductor crimping portion 311 that is crimped to the conductor 11 exposed by removing the insulating covering portion 12 on the terminal portion of the aluminum cable 10, and a conductor enveloping portion 312 that is integrally connected to the conductor crimping portion 311 along an extending direction of the aluminum cable 10, and deformed when being crimped to the aluminum cable 10 in substantially the same shape as a case of being crimped to the insulating covering portion 12 so as to envelop a portion of the conductor 11 in a vicinity of the insulating covering portion 12, and a second crimping portion 32 that is formed of a tubular metallic member separate from the first crimping portion 31, and crimped to an outer peripheral surface 12*a* of the insulating covering portion 12 in a vicinity of the conductor 11 of the aluminum cable 10 that is inserted into the tube, and wherein the first crimping portion 31 and the second crimping portion 32 are integrally interconnected to each other by sealing a gap S1 of the first crimping portion 31 that is crimped to the aluminum cable 10 with a sealer 40, and by sealing a gap S2 between the first crimping portion 31 and the second crimping portion 32 with the sealer 40.

[2] The aluminum cable 1 with crimping terminal according to the configuration (1), wherein the second crimping portion 32 has the same thickness as the first crimping portion 31.

[3] The aluminum cable 1 with crimping terminal according to the configuration (1) or (2), wherein the sealer 40 is a conductive material.

[4] The aluminum cable 1 with crimping terminal according to the configuration (1) or (2), wherein the conductor enveloping portion 312 is integrally connected to the conductor crimping portion 311 along an extending direction of the aluminum cable 10 without a gap between the conductor enveloping portion 312 and the conductor crimping portion 311.

[5] The aluminum cable 1 with crimping terminal according to the configuration (1) or (2), wherein the sealer 40 is a conductive material, and the conductor enveloping portion 312 is integrally connected to the conductor crimping portion 311 along an extending direction of the aluminum cable 10 without a gap between the conductor enveloping portion 312 and the conductor crimping portion 311.

Hereinbefore, the present invention made by the inventor has been described in detail on the basis of the above-described example of the present invention, but the present invention is not limited to the above-described example of the present invention, and various modifications can be made in a range not departing from the gist of the present invention.

According to the aluminum cable with crimping terminal in the present invention, it is possible to provide an aluminum cable with crimping terminal in which a portion crimped to a conductor and a portion crimped to an insulating covering portion are integrally formed, capable of improving a waterproof property of the portion crimped to the insulating covering portion.

What is claimed is:

1. An aluminum cable with crimping terminal comprising:

an aluminum cable including a conductor formed of aluminum or aluminum alloy and an insulating covering portion that envelops an outer periphery of the conductor, and a crimping terminal including a crimping portion that is crimped to the aluminum cable and electrically connected to the aluminum cable, wherein the crimping portion includes a first crimping portion including a conductor crimping portion that is crimped to the conductor exposed by removing the insulating covering portion on the crimping terminal of the aluminum cable, and a conductor enveloping portion that is integrally connected to the conductor crimping portion along an extending direction of the aluminum cable, and deformed when being crimped to the aluminum cable in substantially the same shape as a case of being crimped to the insulating covering portion so as to envelop a portion of the conductor in a vicinity of the insulating covering portion, and a second crimping portion that is formed of a tubular metallic member separate from the first crimping portion, and crimped to an outer peripheral surface of the insulating covering portion in a vicinity of the conductor of the aluminum cable that is inserted into the tube, and wherein the first crimping portion and the second crimping portion are integrally interconnected to each other by sealing a gap of the first crimping portion that is crimped to the aluminum cable with a sealer, and by sealing a gap between the first crimping portion and the second crimping portion with the sealer.

2. The aluminum cable with crimping terminal according to claim 1, wherein the second crimping portion has the same thickness as the first crimping portion.

3. The aluminum cable with crimping terminal according to claim 1, wherein the sealer is a conductive material.

4. The aluminum cable with crimping terminal according to claim 1, wherein the conductor enveloping portion is integrally connected to the conductor crimping portion along an extending direction of the aluminum cable without a gap between the conductor enveloping portion and the conductor crimping portion.

5. The aluminum cable with crimping terminal according to claim 1, wherein the sealer is a conductive material, and the conductor enveloping portion is integrally connected to the conductor crimping portion along an extending direction of the aluminum cable without a gap between the conductor enveloping portion and the conductor crimping portion.

* * * * *